United States Patent [19]

Spangler

[11] 4,184,725

[45] Jan. 22, 1980

[54] BOOK-HOLDING APPARATUS FOR KITCHEN TYPE CABINET

[76] Inventor: James L. Spangler, Box 2152, Lake Havasu City, Ariz. 86403

[21] Appl. No.: 941,336

[22] Filed: Sep. 11, 1978

[51] Int. Cl.[2] ..... A47B 63/00; A47B 46/00; A47B 88/18

[52] U.S. Cl. ..... 312/233; 248/447; 312/246; 312/323; 312/348

[58] Field of Search ..... 312/248, 246, 245, 307, 312/323, 322, 247, 233, 348; 248/240.1, 447

[56] References Cited

U.S. PATENT DOCUMENTS

| | | | |
|---|---|---|---|
| 2,254,832 | 9/1941 | Wright | 312/233 X |
| 2,755,158 | 7/1956 | Davidson | 312/348 |
| 2,839,349 | 6/1958 | Culver | 312/348 |
| 3,407,940 | 10/1968 | Packard | 312/348 |
| 3,485,544 | 12/1969 | Breckerman | 312/245 |

FOREIGN PATENT DOCUMENTS

| | | | |
|---|---|---|---|
| 245460 | 11/1946 | Switzerland | 312/323 |

*Primary Examiner*—Alexander Grosz
*Attorney, Agent, or Firm*—Charles E. Cates

[57] ABSTRACT

The disclosure teaches a book-holding apparatus to be used with a kitchen cabinet and the like. A leaf, to be used as a book-holder, is provided with means for retaining the book on the upper surface of the leaf and means to hold the book open at a desired page. The leaf is enclosed in a box frame having two spaced sides and a back. Means for supporting the leaf within the frame is provided as a slot carried in each side and back of the frame. At the front of the frame the slot expands upwardly and downwardly. A flange extending from a surface of the leaf is adapted to engage a first stop member to limit the forward movement of the leaf relative the frame. When it is thus limited the forward end of the leaf is outward and its weight causes the leaf to rotate about the first stop member. The rotation of the leaf is limited by a second stop member defined by a forward wall in the upward vault of the slot which engages the upper surface of the back end of the leaf as the leaf pivots about the first stop member. The wall may be positioned to engage the back end of the leaf and stop its movement at any selected angle of repose. Thereafter, a book may be placed on the leaf for convenient inspection.

4 Claims, 4 Drawing Figures

BOOK-HOLDING APPARATUS FOR KITCHEN TYPE CABINET

BACKGROUND OF THE INVENTION

This invention relates to apparatus for concealing a book support until desired for use. More specifically, it relates to such devices for use under kitchen cabinets and similar cabinet structures.

In the prior art a number of efforts to provide concealed book-holding apparatuses have been made. Representative of the prior art are the U.S. Pat. Nos. to Weight, 2,254,832; Beckerman, 3,485,544; Stocker, 1,260,089; Harper, 3,846,005; Higley, 2,492,697; Talman, 536,709; and Cuni, 2,686,098.

Representative of the inventions of the prior art is that of Weight. It is a very complicated apparatus which requires not only cabinet woodwork, but extensive metal work as well. Indeed, it is a common failing of the prior art that the solutions contemplated are either excessively complicated and expensive or unsuited to the object of concealing a book-holder under a kitchen type cabinet until it is desired for use.

There exists a need for a hidden bookcase holder which the housewife can pull out from under the kitchen cabinet when needed. I conceived this invention as a result of observing the difficulties of supporting heavy cookbooks in use in the kitchen. Although there has been a felt need over many years, it is probable that none of the prior art proposals have been widely adopted because of the expense and complications of constructing them.

Accordingly, my invention satisfies a long felt need for a simple, effective and inexpensive apparatus for concealing a book-holder under a kitchen cabinet or the like which book-holder may be readily extracted when needed and which is unobtrusive and decorative when not in use.

BRIEF DESCRIPTION OF THE INVENTION

In the novel book-holding apparatus of this invention I provide a leaf which may be considered as having spaced upper and lower surfaces and front and back ends. I provide means for retaining a book on the upper surface of the leaf which conveniently may be a flange on the front end of the leaf which becomes a decorative part of the apparatus when the leaf is recessed and not in use.

I also provide a box frame having at least two spaced sides which may be considered as having front and back ends, and preferably a third side is provided at the back. Optionally, top and bottom floors may be provided between the frames such that essentially an enclosed box is presented when the fourth side is covered by the leaf flange.

Within the frame I provide means for supporting and guiding the leaf which are specially constructed slots carried in the spaced sides of the box frame, and optionally in the back end.

I also provide a first stop member which is carried by the front ends of the sides of the frame. Conveniently, this may be a dowel or bar having a cross-section other than round which is supported by the two sides of the box frame or it may be projecting inwardly from the sides as separate fingers.

A second flange extends from either surface of the leaf and is spaced somewhat from the back end of the leaf. This flange is adapted to engage the first stop member to limit the forward movement of the leaf relative the frame.

There also is provided a second stop member which is disposed at the front end of the frame and which is formed by enlarging the slots carried in the side walls. The second stop member is spaced upwardly from the first stop member to engage the upper surface of the back end of the leaf when the leaf is withdrawn from the frame and the flange engages the first stop member. Upon such engagement the front end of the leaf tends to drop by its own weight and the back end of the leaf rises, thereby causing the leaf to pivot around the first stop member. The leaf's pivotal motion is limited by the second stop member which holds the book at a desired angle for convenient inspection.

DETAILED DESCRIPTION OF THE PREFERRED EMBODIMENT

Turning now to the drawings in which a presently preferred embodiment of the invention is displayed:

Figure 1:
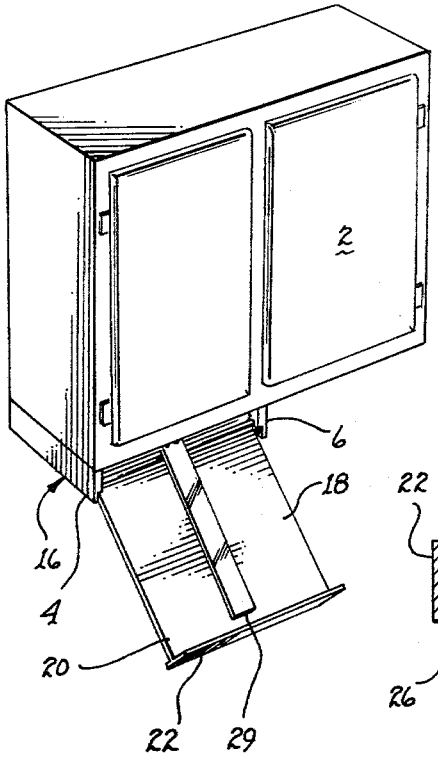
FIG. 1 is a perspective view of a kitchen cabinet with the apparatus of this invention installed in place.

Turning now to FIG. 1, the kitchen cabinet 2, which is not a part of this invention, is shown to provide a setting and a point of reference for the display of the invention. In this embodiment a box frame having two sides 4,6 and back 12 is provided. It is attached to the cabinet 2 by means of mounting bar 14 which is inset in sides 4,6 and secured by any suitable fashion such as glue, nails, screws, etc.

Figure 3:
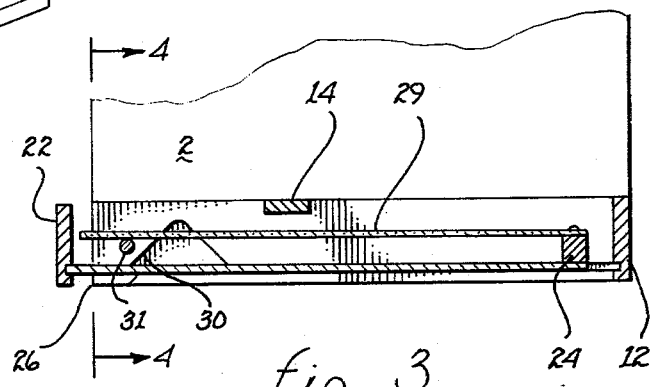
FIG. 3 is a view of FIG. 2 with the leaf retracted.
Figure 2:
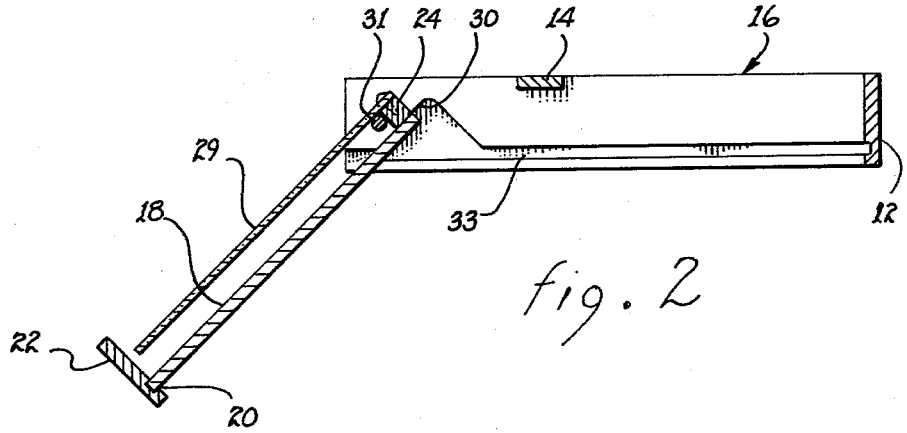
FIG. 2 is a side elevation in cross-section of the apparatus of FIG. 1.
Figure 4:
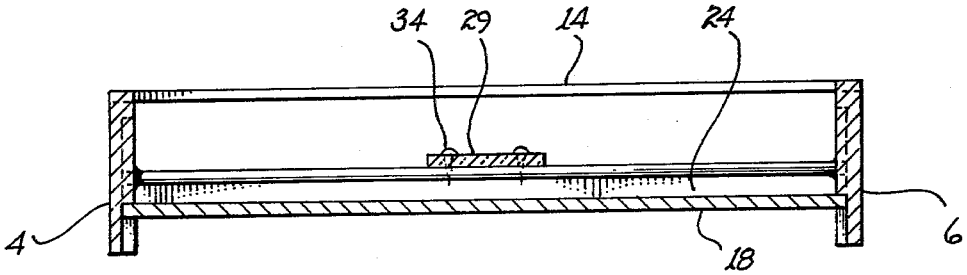
FIG. 4 is a cross-section of the apparatus shown in FIG. 3 along the lines 4—4.

Housed within the box frame 16 is a leaf 18 which has at its forward end 20 a flange 22 which extends both above and below the leaf 18 and which serves as the decorative face of the box frame when the leaf is retracted as shown in FIG. 3. The back end 22 of the leaf 18 is provided with a flange 24.

When the leaf 18 is recessed within the box frame, as shown in FIG. 3, it is supported in grooves or slots 33 which serve as a support and guide means. The slots 33 are formed in sides 4, 6 and back 12. As the slots 33 approach the front end 26 of the sides 4, 6 the slots are widened to form a vault upwardly and a drop downwardly. The vault has a side 30 which serves as a second stop member. The drop portion of the slot 33 permits the leaf 18 to fall at the point its outward motion is arrested by rod 31. The vault and drop of the slot cooperate to permit the leaf to rotate around the rod 31 to a point limited by side 30 of the vault.

Flange 22 serves to hold a book in place. Flexible member 29 also assists in this function and that of holding the book open to the desired page. It is attached to the flange 24 by means of screws 34.

USE OF THE BOOK-HOLDER

As the leaf 18 is withdrawn from the box frame 16 the outward motion of the leaf is arrested when the flange 24 encounters rod 31. The weight of the forward end of the leaf causes the forward end to drop and the back end of the leaf to rise whereby the leaf 18 pivots around the rod 31. The pivot of the leaf is arrested by side 3D which serves as a second stop member.

Having fully disclosed my invention and the presently preferred embodiment thereof, I claim:

1. Book-holding apparatus for use with a kitchen type cabinet comprising:

(a) a leaf having spaced upper and lower surfaces and front and back ends;

(b) means for retaining a book on the upper surface of said leaf;

(c) a box frame having at least two spaced sides having front and back ends;

(d) means for fastening said frame to a cabinet underside;

(e) guide means for slidably supporting and directing said leaf carried in said sides of said frame, comprising means defining a pair of cooperating slots in said sides adapted to slidably receive the edges of said leaf, said slots expanding upwardly at the front end of said sides, whereby the back end of said leaf can be rotated upwardly in the expanded portion of said slots;

(f) a first stop member comprising a rod carried by the front ends of the sides of said frame;

(g) a flange extending from one of the surfaces of, and spaced from the back end of, said leaf and adapted to engage said first stop member to limit outward movement of said leaf relative said frame;

(h) a second stop member disposed at the front end of said frame and spaced upwardly from said first stop member to engage the upper surface of the back end of said leaf when said leaf is withdrawn from said frame and said leaf pivots around said first stop member; whereby said leaf's pivotal motion is limited at a desired angle to receive and hold a book for convenient inspection.

2. The apparatus of claim 1 wherein said means for holding a book also forms the front panel of the box frame when the leaf is recessed in said frame.

3. The apparatus of claim 1 wherein said leaf is one rigid piece.

4. The apparatus of claim 1 with the addition of a flexible arm carried by said flange.

* * * * *